US005522533A

United States Patent [19]

Mukoyama et al.

[11] Patent Number: 5,522,533

[45] Date of Patent: Jun. 4, 1996

[54] MAGAZINE FOR USE WITH FASTENER DRIVING TOOL

[75] Inventors: Kenji Mukoyama; Noriaki Hayashi, both of Anjo, Japan

[73] Assignee: Makita Corporation, Anjo, Japan

[21] Appl. No.: 405,851

[22] Filed: Mar. 17, 1995

[30] Foreign Application Priority Data

Mar. 18, 1994 [JP] Japan ..... 6-049002
Mar. 18, 1994 [JP] Japan ..... 6-049003

[51] Int. Cl.[6] ..... B25C 1/04

[52] U.S. Cl. ..... 227/109; 227/119; 227/127; 227/136

[58] Field of Search ..... 227/109, 119, 227/127, 135, 136, 120

[56] References Cited

U.S. PATENT DOCUMENTS 4,174,802 11/1979 Maestri ..... 227/109
4,304,349 12/1981 Novak et al. ..... 227/109
4,524,896 6/1985 Morrell, Jr. ..... 227/127
4,749,115 6/1988 Fehrs .
4,815,647 3/1989 Chou ..... 227/109
5,269,451 12/1993 Udagawa et al. ..... 227/136

*Primary Examiner*—Scott A. Smith
*Attorney, Agent, or Firm*—Dennison, Meserole, Pollack & Scheiner

[57] ABSTRACT

A magazine for use with a fastener driving tool is adapted for feeding a fastener stick having fasteners connected in series into a driver guide. The magazine has a magazine body and a slide door. The magazine body has a bottom defining a guide surface for the fastener stick. The slide door is mounted on the magazine body and is slidable in a feeding direction of the fastener stick relative to the magazine body between a closed position and an open position. The slide door in the closed position and the bottom of said magazine body cooperate to define a fastener storing chamber for storing the fastener stick therebetween. The fastener storing chamber is opened to the outside when the slide door is at the open position. A pusher serves to push the fastener stick in the fastener storing chamber in the fastener feeding direction. A directing member serves to direct the rear portion of the fastener stick toward the bottom of said magazine body prior to pushing the fastener stick by the pusher when the slide door is moved from the open position to the closed position.

6 Claims, 6 Drawing Sheets

MAGAZINE FOR USE WITH FASTENER DRIVING TOOL

BACKGROUND OF THE INVENTION

1. Field of the Invention

The present invention relates to a magazine for use with a fastener driving tool such as a nail driving tool.

2. Description of the Prior Art

A conventional magazine for use with a nail driving tool has a body and a slide door defining a nail storing chamber for storing therebetween a nail stick having nails connected in series with each other through gluing. A plurality of elongated plate-like nail guide members are mounted on an inner wall of the slide door. The nail guide members extends parallel to each other and are spaced from each other by a predetermined distance so as to guide various nails having different length. A pusher plate is also mounted on the inner wall of the slide door for pushing the nail stick stored in the nail storing chamber so as to feed the nails into a nail driving channel formed in a nose of the nail driving tool one after another. In order to ensure that even one remaining nail can be reliably fed into the nail driving channel, the pusher plate is positioned to extend forwardly of the nail guide members by a predetermined distance when the pusher plate is not pressed on the nails.

With this construction, if the rear portion of the nail stick stored in the nail storing chamber is raised from the bottom of the body because of deformation caused by warping, etc., the pusher plate does not properly abut on the rear end of the nail stick when it is pressed on the nail stick. If this occurs, the pusher plate cannot properly function. Further, if the nails are brought to engage the slide door, the slide door cannot be moved to its closed position or the nails are damaged.

SUMMARY OF THE INVENTION

It is, accordingly, an object of the present invention to provide a magazine for use with a fastener driving tool in which a pusher plate properly performs a fastener feeding function even if a fastener stick stored in the magazine is deformed to some extent by warping, etc.

It is another object of the present invention to provide a magazine in which a slide door can be moved to its closed position without engagement with a fastener stick stored in the magazine and without causing a damage to the slide door.

It is a further object of the present invention to provide a magazine in which all fasteners of a fastener stick stored in the magazine can be smoothly fed irrespective of the number of the remaining fasteners.

According to the present invention, there is provide a magazine for use with a fastener driving tool and adapted for feeding a fastener stick having fasteners connected in series into a driver guide, comprising:

a magazine body having a bottom defining a guide surface of the fastener stick;

a slide door mounted on the magazine body and slidable in a feeding direction of the fastener stick relative to the magazine body between a closed position and an open position for closing and opening said magazine body, respectively;

the slide door in the closed position and the bottom of said magazine body defining therebetween a fastener storing chamber for storing the fastener stick;

a pusher device for pushing the fastener stick stored in the fastener storing chamber in the fastener feeding direction; and a directing device for directing the rear portion of the fastener stick toward the bottom of the magazine body prior to pushing the fastener stick by the pusher device when the slide door is moved from the open position to the closed position.

The invention will become more apparent from the appended claims and the description as it proceeds in connection with the drawings.

DETAILED DESCRIPTION OF THE PREFERRED EMBODIMENT

An embodiment of the present invention will now be explained with reference to the accompanying drawings.

Figure 1:
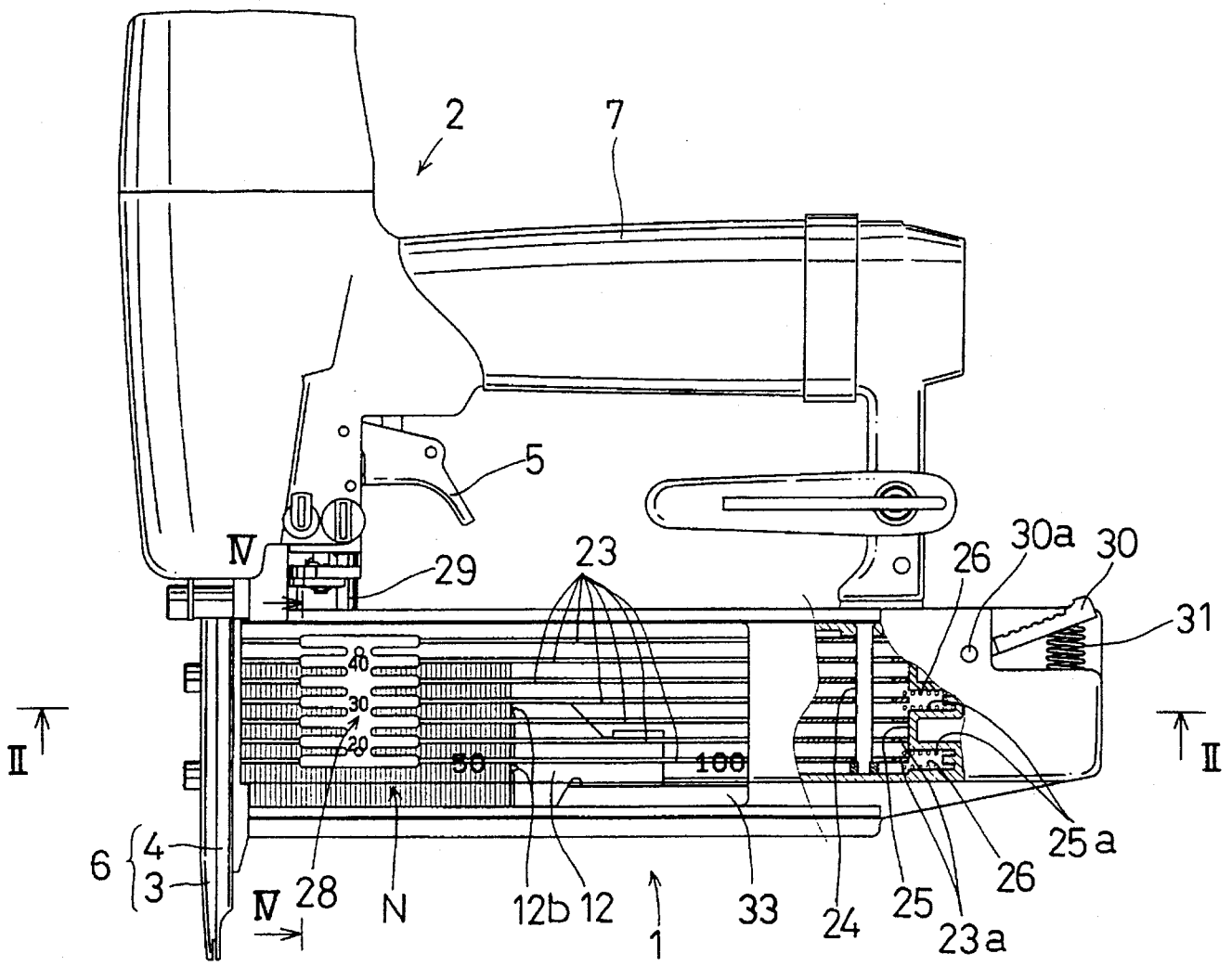
FIG. 1 is a side view of a nail driving tool incorporating a magazine according to an embodiment of the present invention.
Figure 2:
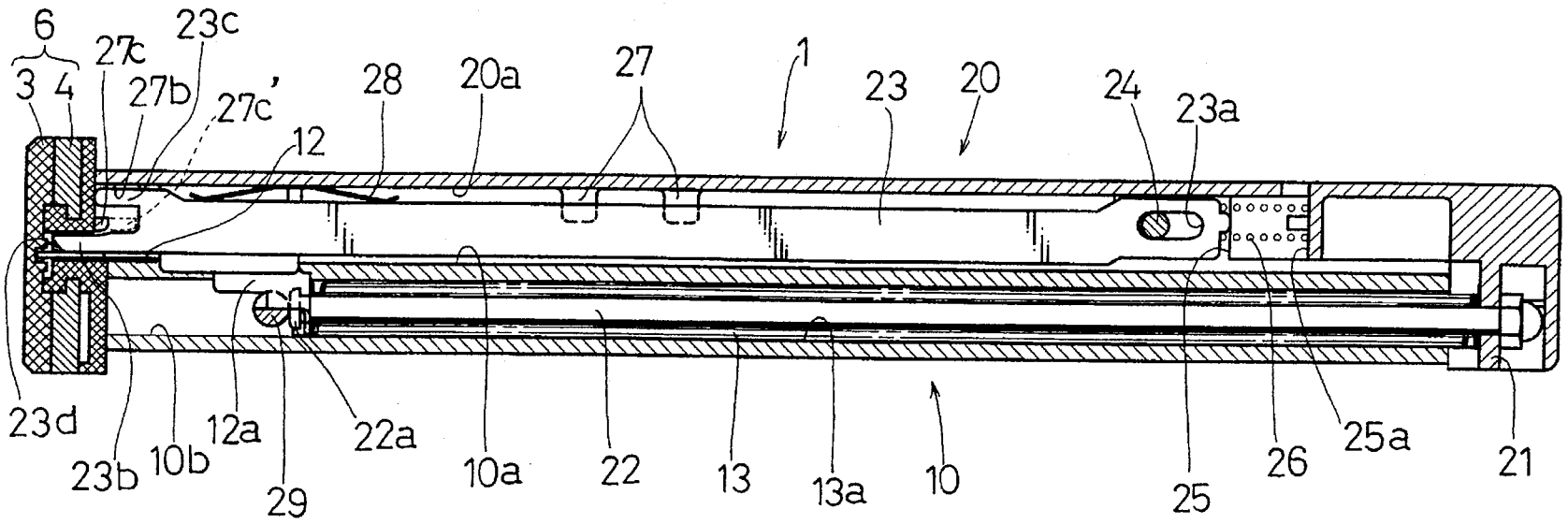
FIG. 2 is a sectional view taken along line II—II in FIG. 1, with a slide door closed.

Referring to FIGS. 1 and 2, there is shown a nail driving tool having a magazine 1 constructed in accordance with this embodiment. The nail driving tool also includes a machine body 2 and a nose 6 extending downwardly from a lower portion of the machine body 2. The nose 6 includes a driver guide 3 and a contact lever 4. The driver guide 3 serves to guide a driver (not shown) which is reciprocally moved within the driver guide 3 for driving nails. The contact lever 4 serves to effectuate an operation of a trigger 6 for driving the driver only when the contact lever 4 is moved upwardly from a position shown in FIG. 1. A handle 7 is mounted on the machine body 2 and extends perpendicular thereto. The handle 7 has a rear end (rightward end in FIG. 1) to which an air hose (not shown) is connected for supplying compressed air to the machine body 2.

Figure 3:
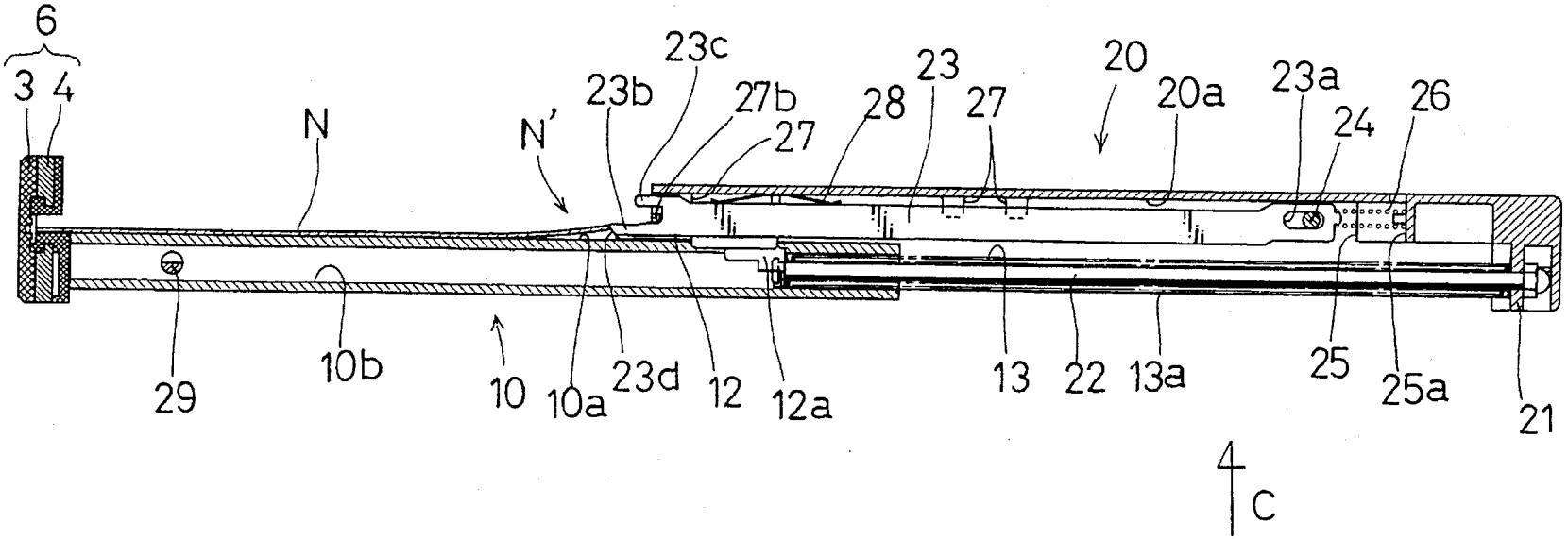
FIG. 3 is a sectional view similar to FIG. 2, with the slide door opened.
Figure 4:
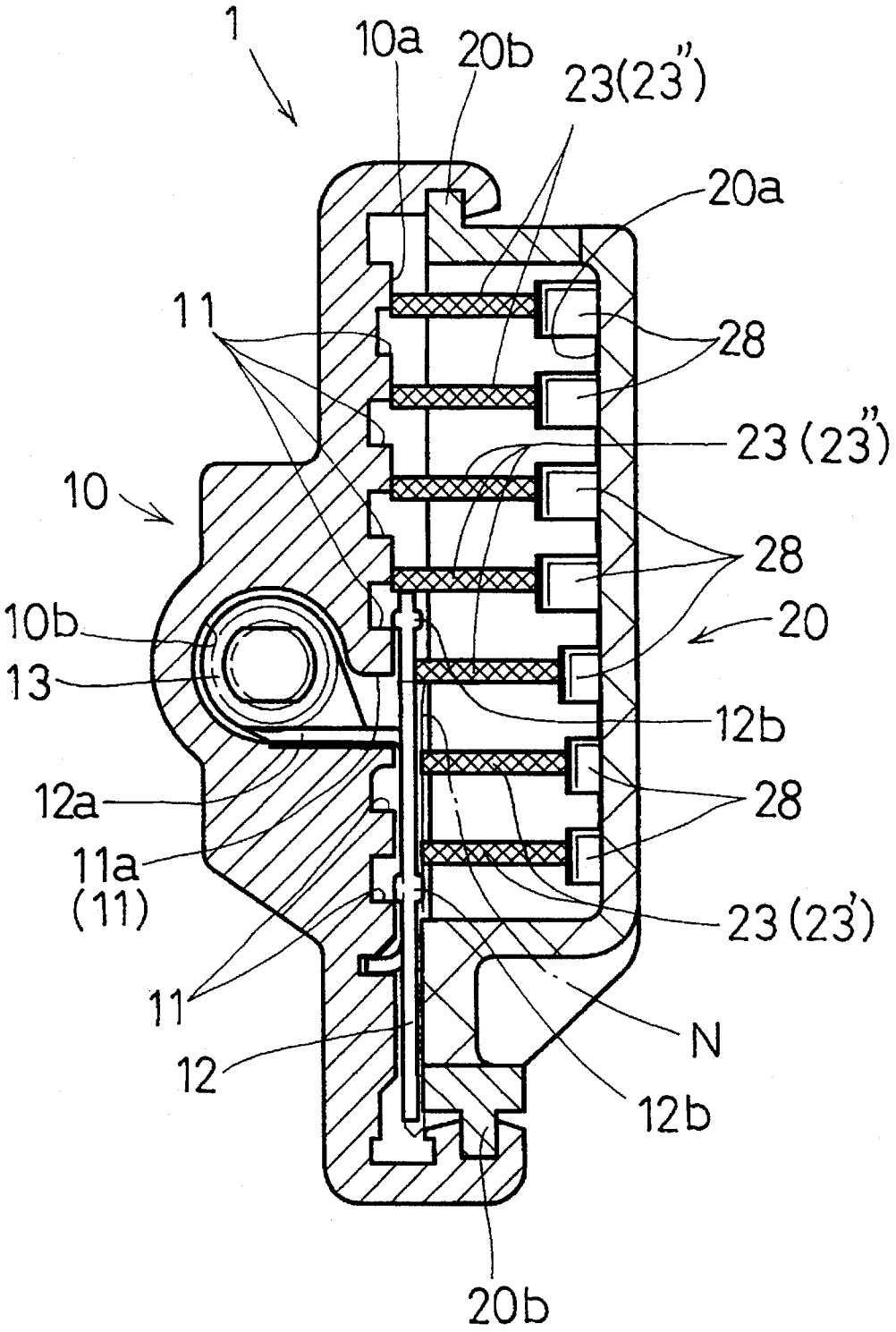
FIG. 4 is a sectional view taken along line IV—IV in FIG. 1.

As shown in FIGS. 2 to 4, the magazine 1 includes an elongated magazine body 10 having a substantially shallow box-like configuration and has an opening which is closed by a slide door 20. The magazine body 10 has a forward end and a rear end which are fixed to a right side surface of the nose 6 and the rear end of the handle 7, respectively, so that the magazine 1 extends substantially parallel to the handle 7. The slide door 20 has an upper and lower edges 20*b* which are slidably received within recesses formed on their corresponding edges of the opening of the magazine body 10, so that the slide door 20 is slidably movable relative to the magazine body 10 in a longitudinal direction thereof so as to close and open the magazine body 10. A flat nail stick N having a plurality of nails connected in series with each other is stored in a nail storing chamber defined between the magazine body 10 and the slide door 20.

As shown in FIG. 4, a plurality of parallel recesses 11 are formed on a bottom 10*a* of the magazine body 10 and extend in the longitudinal direction of the magazine body 10 or in a feeding direction of the nail stick N toward the nose 6. The recesses 11 are spaced from each other by a predetermined distance, so that the recesses 11 serve to receive heads of the nails in the nail stick N having different lengths so as to prevent the nail stick N from moving vertically relative to the bottom 10*a*. A central recess 11*a* which is one of the recesses 11 also serves to guide a pusher plate 12. The pusher plate 12 has a flat plate-like configuration and has a thickness slightly smaller than the thickness of the nails. The pusher plate 12 extends along the bottom 10*a* of the magazine body 10. A support plate 12*a* is fixed to the rear end of the pusher plate 12*a* and has one end which is bent toward the bottom 10*a* and which extends into a spring receiving hole 10*b* through the central recess 11*a*. The spring receiving hole 10*b* is formed on the backside of the bottom 10*a* and is separated from the nail storing chamber by the bottom 10*a*. Further, as shown in FIGS. 2 and 3, the spring receiving hole 10*b* extends substantially over the length of the magazine body 10 in the longitudinal direction.

On the other hand, a support wall 21 is formed on a rear end of the slide door 20. An elongated shaft 22 is supported by the support wall 21 and extends forwardly (in the nail feeding direction) therefrom. The support plate 12*a* of the pusher plate 12 is slidably fitted on the shaft 22, so that the pusher plate 12 is movable along the shaft 22. The shaft 22 has a head 22*a* which defines a forward stroke end of the pusher 12 relative to the slide door 20. A compression coil spring 13 is fitted on the shaft 22 for biasing the pusher plate 12 in the forward direction or the nail feeding direction. A tubular cover 13*a* is slidably fitted on the compression coil spring 13 so as to prevent the compression coil spring 13 from deformation into a zigzag configuration, so that the compression coil spring 13 can be smoothly compressed and expanded. The rear end of the cover 13*a* as well as the rear end of the shaft 22 is fixed to the support wall 21 of the slide door 20. Thus, the compression coil spring 13 and the shaft 22 as well as the cover 13*a* is received within the spring support hole 10*b*. When the slide door 20 is in its closed position shown in FIG. 2, the shaft 22 is positioned in its forwardmost position. When the slide door 20 is in its open position as shown in FIG. 3, the shaft 22 is positioned in its rearmost position where the forward end of the shaft 22 is still remained within the spring support hole 10*b*. The pusher plate 12 is movable together with the shaft 22 as long as the pusher plate 12 does not contact the nail stick N. Thus, as the slide door 20 is moved from its closed position to its open position with the nail stick N stored in the nail storing chamber, the pusher plate 12 stops its forward movement through abutment on the rear end of the nail stick N (or the nail which is to be finally driven), and then the compression coil spring 13 is compressed to apply a biasing force to the nail stick N through the pusher plate 12.

Figure 5:
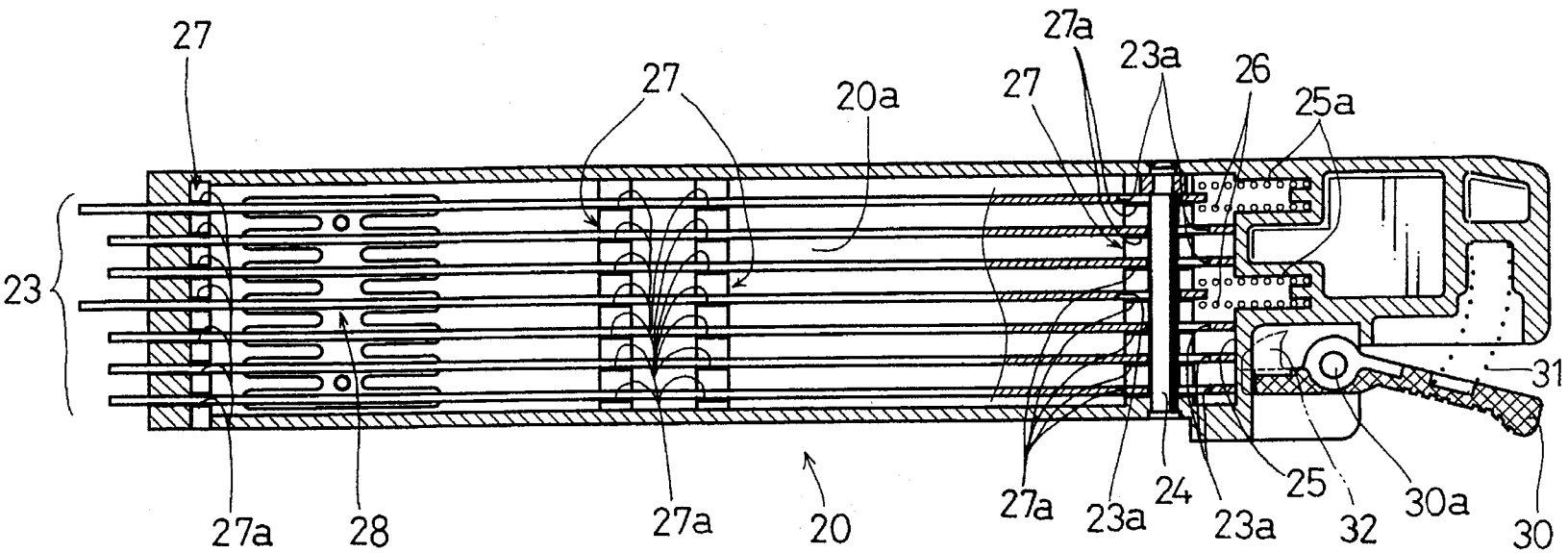
FIG. 5 is a view of the magazine in a direction indicated by an arrow C in FIG. 3.

A plurality of nail guide members 23 are mounted on an inner surface of the slide door 20 and are positioned parallel to each other. Each of the nail guide members 23 has an elongated plate-like configuration and extends in the longitudinal direction of the slide door 20 or the nail feeding direction. As shown in FIG. 5, the slide door 20 includes four ribs 27 formed on an inner wall 20*b* thereof at forward position, a rearward position forwardly of the rear wall 21, and a first and a second central position spaced from each other by a predetermined distance. Each of the ribs 27 has recesses 27*a* extending in the nail feeding direction for receiving their corresponding nail guide members 23 such that the nail guide members 23 are positioned for guiding the heads of the nails having different lengths. Each of the recesses 27*a* has a width slightly greater than the thickness of its corresponding nail guide members 23.

As shown in FIG. 5, a pin 24 is supported by the rib 27 which is positioned in the rearward position. The pin 24 extends in a widthwise direction of the slide door 24 or a direction perpendicular to the nail guide members 23. The pin 24 is fixed to the slide door 24 and inserted into elongated slot 23*a* formed on a rear end of each nail guide member 23 and extending in the nail feeding direction, so that each nail guide member 23 is pivotable about the pin 24. As shown in FIGS. 1 and 5, a vertical wall 25 is formed integrally with the inner wall 20*a* of the slide door 20 and is positioned adjacent and rearwardly of the rearward rib 27. The vertical wall 25 has two recesses 25*a* formed at positions confronting the rear ends of the first and fourth nail guide members 23 counted from the lowermost one (counted from the uppermost one in FIG. 5). A compression coil spring 26 is inserted into each of the recesses 25*a*, so that the first and fourth nail guide members 23 are biased in the nail feeding direction. Thus, each the first and fourth nail guide members 23 are normally held in position where the pin 24 abuts on the rear end of the elongated slot 23*a* and where the first and fourth nail guide members 23 extends forwardly of the other nail guide members 23. Here, the rear ends of the nail guide members 23 other than the first and the fourth ones are in abutment on the vertical wall 25 as will be explained later.

As shown in FIGS. 2 and 3, each of the nail guide members 23 has a fork-like forward end including a right finger 23*b* and a left finger 23*c* (positioned upside and downside in FIGS. 2 and 3). On the other hand, the rib 27 positioned in the forward position has a plurality of slots 27*b* positioned adjacent their corresponding recesses 27*a*, respectively. Each of the slots 23 is spaced from its corresponding recess 27*a* in a lateral direction of the slide door 20 (the vertical direction in FIGS. 2 and 3) and has an elongated configuration in the lateral direction. Each of the slots 23 receives the left finger 23*c* of its corresponding nail guide member 23 so as to permit pivotal movement of the nail guide member 23 around the pin 24 within a predetermined angle. The right finger 23*b* is received within the corresponding recess 27*a* and extends along the bottom 10*a* of the magazine body 10. The right finger 23*b* has a length greater than the left finger 23*c*, so that the right finger 23*b* extends forwardly of the left finger 23*c*. The right finger 23*b* has a cam surface 23*d* at its forward end. The cam surface 23*b* has an inclination such that the distance between the cam surface 23*d* and bottom 10 increases in the feeding direction or decreases in the rearward direction. With this construction, as the slide door 20 is moved from its open position to its closed position, the cam surfaces 23*d* of the nail guide members 23, which are positioned within the range of the length of the nails of the nail stick N stored in the nail storing chamber, abut on the rear end of the nail stick N so as to direct the same toward the bottom 10*a* of the magazine body 10.

Here, as described above, the first and fourth nail guide members 23 are normally held in position where they extend forwardly of the other nail guide members 23. At this position, the right fingers 23*b* of the first and fourth nail guide members 23 extend forwardly of a forward end of the pusher plate 12 which is not pressed on the nail stick N or which is stopped by the head 12*a* of the shaft 22 against the biasing force of the compression coil spring 13. Therefore, the right fingers 23*b* of the first and the fourth nail guide members 23 abut on the rear end of the nail stick N for directing the same toward the bottom 10*a* prior to abutment of the pusher plate 12 on the nail stick N. On the other hand, the right fingers 23*b* the nail guide members 23 other than first and fourth ones are fixed in a position rearwardly of the forward end of the pusher plate 12.

As shown in FIG. 2, a partition wall 27*c* is formed between the recess 27*a* and the slot 27*b* for receiving the fingers 23*b* and 23*c* of each of the first and fourth nail guide members 23. The partition wall 27*c* has a thickness smaller than the thickness of a partition wall 27*c*' for the other nail guide members 23, so that the first and the fourth nail guide members 23 are permitted to position forwardly of the other nail guide members 23. The movement of the other nail guide members 23 are substantially inhibited between their corresponding partition walls 27*c*' and the vertical wall 25.

A leaf spring 28 is interposed between the forward portion of each of the nail guide members 23 and the inner wall 20*a* of the slide door 20, so that the forward portions of the nail guide members 23 are biased in a direction toward the bottom 10*a* of the magazine body 10 or in a direction toward the nail stick N. Therefore, when the slide door 20 is moved from its open position to its closed position, as shown in FIG. 4, the nail guide members 23 positioned within the length of the nails (two in number in this embodiment and indicated at 23') are moved away from the bottom 10*a* by the distance corresponding to the thickness of the nails through abutment on the rear end of the nail stick N against the biasing force of their leaf springs 28. Thus, the nail guide members 23' press the nail stick N on the bottom 10*a* so as to prevent raising of the nail stick N from the bottom 10*a* or so as to prevent deformation such as warping. On the other hand, the other nail guide members 23 (five in number in this embodiment and indicated at 23") are kept in position to extend over the nails. Particularly, the third nail guide member 23" (counted from the lower most one) extends just above the heads of the nails so as to prevent the nails from movement in their axial directions.

As shown in FIGS. 1 and 5, a lock lever 30 is pivotally mounted on the rear end of the slide door 20 by means of a pin 30*a*. The lock lever 30 has a lock craw 32 and is pivotable between an engaging position for engagement with a part of the magazine body 10 and a disengaging position for disengagement therefrom. A compression coil spring 31 is interposed between the lock lever 30 and the slide door 20 for holding the lock lever 30 in the engaging position when the slide door 20 is in its closed position. Thus, when an operator presses the lock lever 30 against the biasing force of the compression coil spring 31, the lock craw 32 is disengaged, so that the operator can move the slide door 20 from its closed position to its open position. On the other hand, when the slide door 20 is moved from its open position to its closed position, the lock craw 32 automatically engages the part of the magazine 10, so that the slide door 20 is locked in the closed position.

A check bar 29 is operably connected to the trigger 5 and serves to prevent an idle driving of the driver when no nail exists in the magazine 1. The check bar 29 has a lower end which is inserted into the magazine 1 and extends into the spring receiving hole 10*b*. When the number of nails in the nail stick N stored in the magazine 1 is less than a predetermined number, the support plate 12*a* of the pusher plate 12 is brought to engage the check bar 29 so as to prevent upward movement of the check bar 29. Thus, the trigger 5 is prevented from being pulled by the operator, so that the idle driving of the driver is prevented.

Further, as shown in FIG. 1, a part 33 of the slide door 20 defining the nail storing chamber in cooperation with the bottom 10*a* of the magazine body 10 is made of a transparent material. The other part of the slide door 20 as well as the magazine body 10 is made of an opaque material. The transparent part 33 permits the operator to visually recognize the number of nails remaining in the nail storing chamber. To this end, numerals "50" and "100" are affixed to the transparent part 33 so as to indicate the number of the nails. Further, numerals "20", "30" and "40" are affixed to the transparent part 33 so as to indicate the length of the nails.

With the magazine 1 thus constructed, the slide door 20 is moved from its open position to its closed position with the nail stick N set on the bottom 10*a* of the magazine body 10. Then, the left finger 23*b* of the first nail guide member 23 (and the left finger 23*b* of the fourth nail guide member 23) abuts on the rear end of the nail stick N prior to abutment of the pusher plate 12 on the same. The rear end of the nail stick N is therefore directed by the cam surface 23*d* of the left finger 23*b* toward the bottom 10*a*. The pusher plate 12 thereafter abuts on the rear end of the nail stick N.

Thus, even if a rear portion N' of the nail stick N is warped or raised from the bottom 10*a* of the magazine body 10 as shown in FIG. 3, the rear portion N' is pressed on the bottom 10*a* under the guide of cam surface 23*d* of the first nail guide member 23, so that the rear portion N' is reformed into a straight configuration. The pusher plate 12 can therefore reliably abut on the rear end of the nail stick N to feed the nails into the driver guide 3. Further, the slide door 20 can be smoothly closed without interference by the warped rear portion N' of the nail stick N.

As the slide door 20 is further moved to be closed after the pusher plate 12 has abutted on the rear end of the nail stick N, the pushing force of the pusher plate 12 or the feeding force of the nails increases. When the slide door 20 reaches its closed position and is locked by the lock lever 30, the right fingers 23*c* of the first and fourth nail guide members 23 abut on a rear surface of the nose 6 and are moved rearwardly to a position where the forward ends of the first and fourth nail guide members 23 are in alignment with the forward ends of other nail guide members 23.

As described above, with this embodiment, the warped rear portion N' of the nail stick N is reformed into the straight configuration by the first nail guide member 23 (and the fourth nail guide member 23) prior to the pushing operation by the pusher plate 12, so that the pusher plate 12 can reliably apply the pushing force to the nail stick N. In addition, the slide door 20 can be smoothly closed without causing a damage to the nails and without being prevented by the nails.

Further, as shown in FIG. 4, the pusher plate 12 has a thickness smaller than the thickness of the nails in the nail stick N, so that the nail guide members 23 disposed within the height of the pusher plate 12 can reliably guide the heads of the nails having short lengths. Further, nodes 12*b* are formed on the forward end of the pusher plate 12 at suitable positions not to interfere with the nails guide members 23, so that the pusher plate 12 can reliably push the nail stick N although the pusher plate 12 itself has a relatively smaller thickness.

Although in the above embodiment, the nail guide members 23 are seven in number and two of them are movable in the feeding direction and extend forwardly of the pusher plate 12 when the slide door 20 is opened, the number of the nail guide members 23 as well as the number of movable ones can be selectively determined. Thus, at least one of the suitable number of the nail guide members 23 having the cam surface 23*d* is determined as the movable one.

On the other hand, within the magazine 1 of this embodiment, the nails guide members 23 are biased by their corresponding leaf springs 28 such that only their forward portions are pressed toward the bottom 10*a* or toward the nail stick N. The rear portions of the nail guide members 23 are pivotally supported by the pin 24.

Figure 6A:
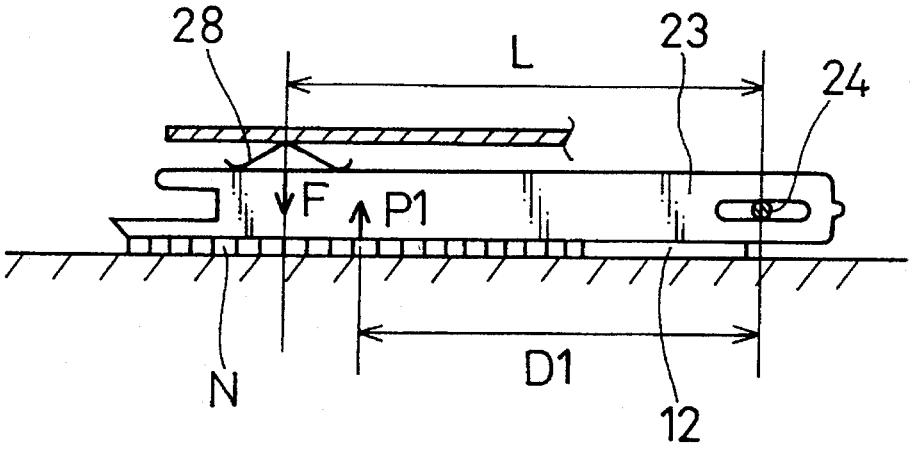
FIGS. 6(*a*) and 6(*b*) are explanatory views showing the relationship between the amount of nails in a nail stick and moving resistance applied to the nail stick.
Figure 6B:
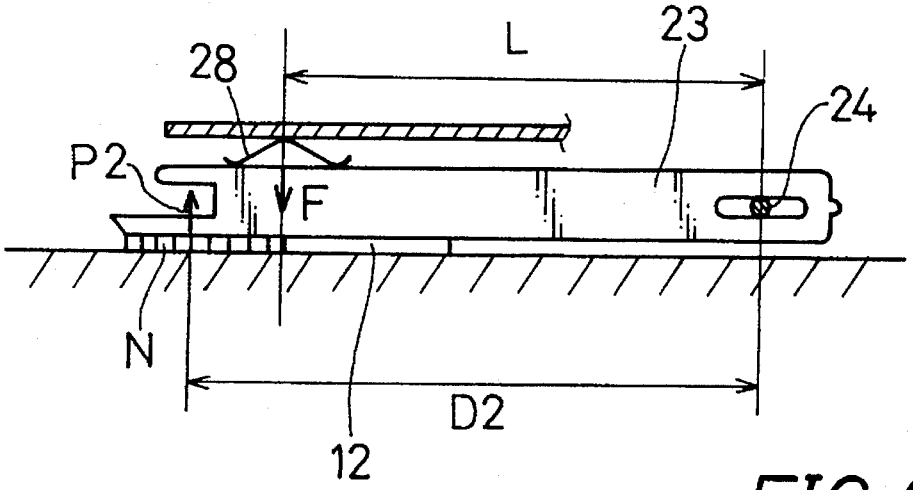

Thus, as shown in FIGS. 6(*a*) and 6(*b*), each of the nail guide members 23 within the length of the nails applies a pressing force F to the nail stick N, so that the bottom 10*a* of the magazine body 10 applies a reaction force P (P1, P2) to the nail stick N. Such a reaction force P produces a resistance force P against the movement of the nail stick N. The resistance force P may be presumed that it is applied to the center of the nail stick N in its longitudinal direction. Thus, the resistance force P1 applied to the nail stick N having a smaller amount of nails as shown in FIG. 6(*b*) is smaller than the resistance force P2 applied to the nail stick N having a greater amount of nails as shown in FIG. 6(*a*). Thus, the following relationship can be established:

$$F \times L = P1 \times D1 = P2 \times D2$$

$$P1 > P2 \text{ since } D1 < D2$$

L: distance between the pin 24 and the leaf spring 28

D1, D2: distance between the pin 24 and the central position of the nail stick N In contrast, with a conventional magazine as disclosed in U.S. Pat. No. 4,749,115, the whole nail guide member is pressed toward a bottom of a magazine body, or biasing forces are applied to the nail guide member on both forward end rear ends thereof. In such a case, a resistance force applied to a nail stick may not vary with the remaining amount of nails in the nail stick. This means that a greater resistance force is applied to the nail stick having a smaller amount of nails, resulting in that the nail stick is difficult to be moved.

Thus, with this embodiment, although the pushing force applied to the nail stick N is decreased as the amount of the nails is reduced, the resistance force P against the movement of the nail stick N is reduced to permit smooth feeding of the nail stick N.

Additionally, since the pusher plate 12 is not required to push the nail stick N against a greater resistance force, the compression spring 13 may have a smaller biasing force, and the pushing force can be easily determined.

Although, in the above embodiment, the leaf springs 28 are incorporated to bias the nail guide members 23, any suitable biasing elements such as compression springs and rubbers can be incorporated in place of the leaf springs 28.

Further, although the above embodiment has been described in connection with a driving tool for driving nails, the same construction can be incorporated into a driving tool for driving other fasteners such as pins.

While the invention has been described with reference to a preferred embodiment thereof, it is to be understood that modifications or variation may be easily made without departing from the spirit of this invention which is defined by the appended claims.

What is claimed is:

1. A magazine for use with a fastener driving tool and adapted for feeding a fastener stick having fasteners connected in series into a driver guide, comprising:

a magazine body having a bottom defining a guide surface for the fastener stick;

a slide door mounted on said magazine body and slidable in a feeding direction of the fastener stick relative to said magazine body between a closed position and an open position for closing and opening said magazine body, respectively;

said slide door in said closed position and said bottom of said magazine body defining therebetween a fastener storing chamber for storing the fastener stick;

pusher means for pushing the fastener stick stored in said fastener storing chamber in said fastener feeding direction; and directing means for directing the rear portion of the fastener stick toward said bottom of said magazine body prior to pushing the fastener stick by said pusher means when said slide door is moved from said open position to said closed position.

2. The magazine as defined in claim 1 wherein:

said directing means includes at least one directing member mounted on said slide door and movable with said slide door;

said directing member includes a forward end having an abutting surface for abutment on the rear portion of the fastener stick; and said abutting surface is inclined away from said bottom of said magazine body in said feeding direction.

3. The magazine as defined in claim 1 wherein:

said pusher means includes a pusher member mounted on said slide door and slidably movable relative thereto, said pusher member having a front end for abutting on the rear portion of the fastener stick, a first biasing means for normally biasing said pusher member in said feeding direction, and a first stopper means for holding said pushing member in a first position against the biasing force of said first biasing means when said pusher member does not push the fastener stick, and wherein:

said directing means includes at least one directing member mounted on said slide door and movable with said slide door, said directing member includes a forward end having a cam surface for directing the rear portion of the fastener stick through abutment thereon, a second biasing means for normally biasing said directing member in said feeding direction: and a second stopper means for holding said directing member in a second position against the biasing force of said second biasing means when said directing member does not abut on the fastener stick, and wherein:

said second position of said directing member is positioned forwardly of said first position of said pushing member.

4. The magazine as defined in claim 1 further including fastener guide means mounted on said slide door for guiding heads of the fasteners in the fastener stick, said fastener guide means including a plurality of fastener guide members positioned at different heights from each other for guiding fasteners having different lengths, and wherein said directing means are provided on at least one of said fastener guide members.

5. The magazine as defined in claim 1 further including fastener guide means mounted on said slide door for guiding heads of the fasteners in the fastener stick, said fastener guide means including:

a plurality of fastener guide members each having a longitudinal axis extending parallel to said feeding direction and positioned at different heights from each other for guiding fasteners having different lengths, each of said fastener guide members having a front portion and a rear portion;

support means for pivotally supporting said rear portions of said fastener guide members about a pivotal axis extending perpendicular to said feeding direction; and fastener guide biasing means for biasing said fastener guide members in a direction such that said front portions are directed toward said bottom of said magazine body.

6. The magazine as defined in claim 5 wherein said fastener guide biasing means includes a leaf spring interposed between said slide door and each of said fastener guide members.

* * * * *